US005766119A

United States Patent [19]

Clark

[11] Patent Number: 5,766,119

[45] Date of Patent: Jun. 16, 1998

[54] ROTATING PLATFORM APPARATUS

[76] Inventor: Dexter M. Clark, 2188 E. Spruce, Hillsboro, Oreg. 97123

[21] Appl. No.: 636,764

[22] Filed: Apr. 19, 1996

Related U.S. Application Data

[63] Continuation-in-part of Ser. No. 511,191, Aug. 4, 1995, Pat. No. 5,549,536.

[51] Int. Cl.[6] ..... A63B 23/00

[52] U.S. Cl. ..... 482/146

[58] Field of Search ..... 482/146, 147, 482/79, 40, 23, 30, 95, 80; 472/1, 14, 8, 40

[56] References Cited

U.S. PATENT DOCUMENTS

| | | | |
|---|---|---|---|
| 3,454,273 | 7/1969 | Vogt | 482/147 |
| 3,593,994 | 7/1971 | Anbar | 482/147 |
| 4,285,516 | 8/1981 | Heatwole | 482/146 |
| 4,386,915 | 6/1983 | Gilliam | 482/146 |
| 4,848,742 | 7/1989 | Lindley et al. | 482/146 |
| 4,905,994 | 3/1990 | Hartz | 482/146 |
| 5,279,533 | 1/1994 | Yin et al. | 482/147 |

*Primary Examiner*—Stephen R. Crow
*Attorney, Agent, or Firm*—Rodger H. Flagg

[57] ABSTRACT

Applicant's invention discloses an inclined platform which rotates freely upon a base having an annular ring. The inclined platform preferably has handles extending from opposite sides of the inclined platform to aid in supporting the user thereon. The user shifts their body weight to rotate the inclined platform, thus spinning the user about the base.

7 Claims, 2 Drawing Sheets

ROTATING PLATFORM APPARATUS

This patent application is a continuation-in-part of patent application Ser. No. 08/511,191 filed Aug. 4, 1995, which issued as U.S. Pat. No. 5,549,536 on Aug. 27, 1996 which is incorporated by reference herein.

BACKGROUND OF THE INVENTION

Field of the Invention

This invention relates to an improved rotating platform apparatus, which is useful for recreation and exercise. The prior art discloses a variety of riding, rocking and turning toys, wobble plates, and swivel platforms, which are expensive to manufacture, have limited utility, or provide safety hazards. Many of these prior art devices have not reached the market place for the reasons noted above.

U.S. Pat. 3,088,733 issuing to R. Ayers on May 7, 1963 discloses a riding toy having an inclined platform supported on an obtusely angulated rod secured to the base. The rotation of the inclined platform is limited by the friction of the angulated rod as it rotates within a sleeve without the aid of bearings. The inclined platform is smaller than the base, and both the inclined platform and the base are supported by radially extending angle iron secured to the sleeve.

U.S. Pat. No. 4,290,601 issuing to R. Mittelstadt on Sep. 22, 1981 discloses a wobble plate having a peripheral roller support comprising rollers which contact the underside of treadle board 10 in proximity to the outer periphery of the treadle board. The user may accidentally grab the outer periphery of the treadle board during rotation while attempting to maintain balance, which poses a safety hazard by getting one's fingers between the rollers and the underside of the wobble board.

U.S. Pat. No. 4,193,592 issuing to R. Bishow on Mar. 18, 1908 discloses a rocking, turning toy for use in a sitting, standing or kneeling position. The base has an enlarged protuberance with a flat bottom. A caster assembly is located between the top surface of the lower member and the lower surface of the top member. A shaft extends from the lower surface. The device rotates about the shaft, and rocks upon the enlarged protuberance.

The following patents are representative of other rotating platforms found in this art. They are U.S. Pat. Nos. 5,368,536; 5,279,533; 4,953,858; 4,687,198; 4,605,224; 3,593,994 and 1,565,484.

SUMMARY OF THE INVENTION

Applicant's invention discloses an inclined platform which rotates freely upon a base having an inclined annular bearing ring. The inclined annular bearing ring has an upper bearing surface and a lower bearing surface. Opposing handles extend from opposite sides of the inclined platform to aid in supporting the user thereon. The user shifts their body weight to rotate the inclined platform, thus spinning the user about the base.

The above mentioned and other features and objects of the invention, and the manner of obtaining them will be best understood by reference to the following description of an embodiment of the invention, when considered in conjunction with the accompanying drawings:

BEST MODE FOR CARRYING OUT THE INVENTION

Figure 1:
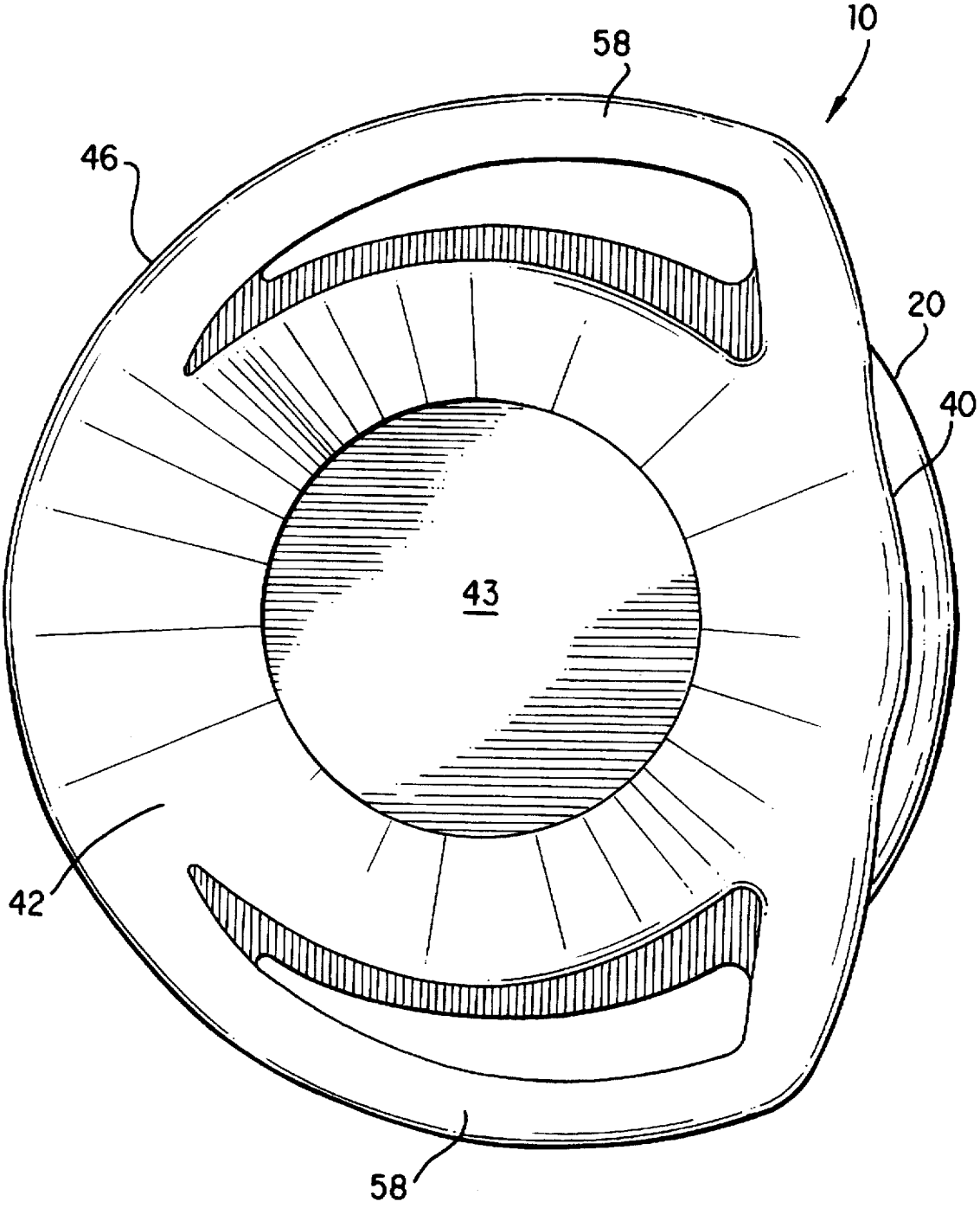
FIG. 1 is a top view of the rotating platform apparatus.
Figure 2:
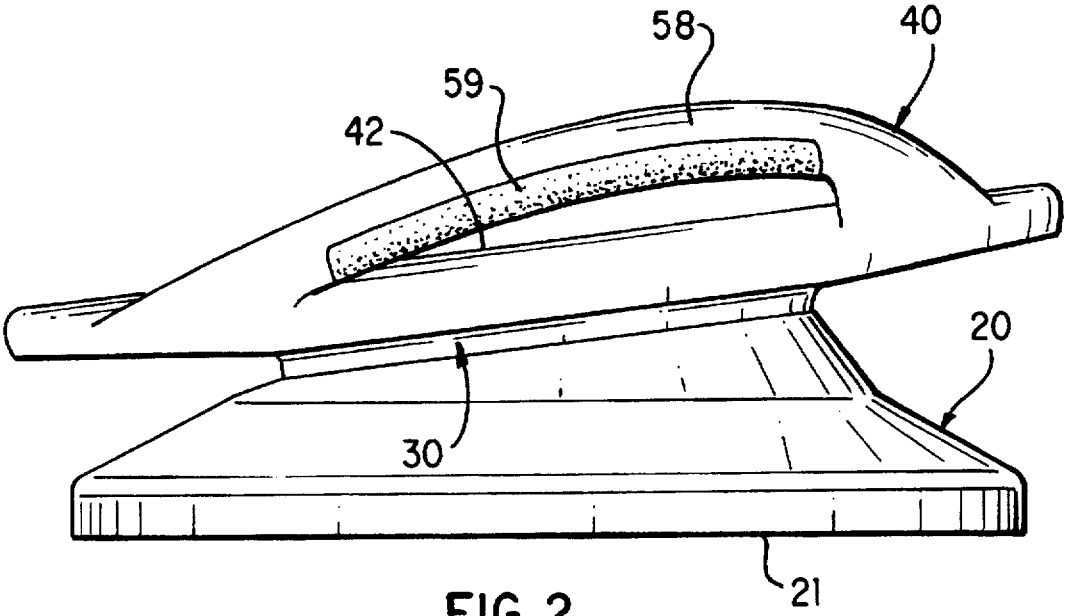
FIG. 2 is a side view of the rotating platform apparatus.

The subject matter which I regard as my invention is particularly pointed out and distinctly claimed in the claims. The structure and operation of my invention, together with further objects and advantages, may be better understood from the following description given in connection with the accompanying drawings, in which:

FIG. 1 and FIG. 2 are respective top and side views of the rotating platform apparatus 10. The base 20 has an annular base bearing surface 31 sized to support the inclined platform 40 thereon. The base 20 is preferably molded as a single piece of plastic material. Alternately, the base 20 may be formed of several parts to suit design or manufacturing preference. Other materials, such as wood, metal or fiberglass, may also be used to construct elements of the base 20 without departing from the scope of this disclosure, or the scope of the following claims.

The annular bearing 30 has a lower bearing surface which rotatably engages the annular base bearing surface 31, and an upper bearing surface 32 which rotatably engages an annular platform bearing surface 33. The annular bearing 30 is preferably sized to be from six inches to sixteen inches in diameter.

As shown in FIG. 2, the inclined annular base bearing surface 31 is inclined at a fixed angle in relation to the horizontal bottom portion 21 of the base 20. The fixed angle is preferably inclined from five to thirty-five degrees from the horizontal bottom portion 21 of the base 20.

The inclined platform 40 is preferably molded as a single piece of plastic material. Alternately, the inclined platform 40 may be made of other conventional materials, such as wood, fiberglass or metal. To suit design or manufacturing preference, the inclined platform may also be made of more than one component part. The inclined platform 40 is sized to support a user thereon.

The top side 42 of inclined platform 40 is preferably molded to form a seat for comfort of the user. The weight of the user upon the top side 42 of the inclined platform 40 ensures that the annular bearing ring 30 will not come loose during rotation. The top side 42 of the inclined platform 40 preferably has a recessed central portion 43. Preferably a flexible lip 35 extends between the inclined platform 40 and the platform base 20. The flexible lip 35 flexes to rotatably secure the platform base 20 to the inclined platform 40 as shown in FIG. 3.

Figure 3:
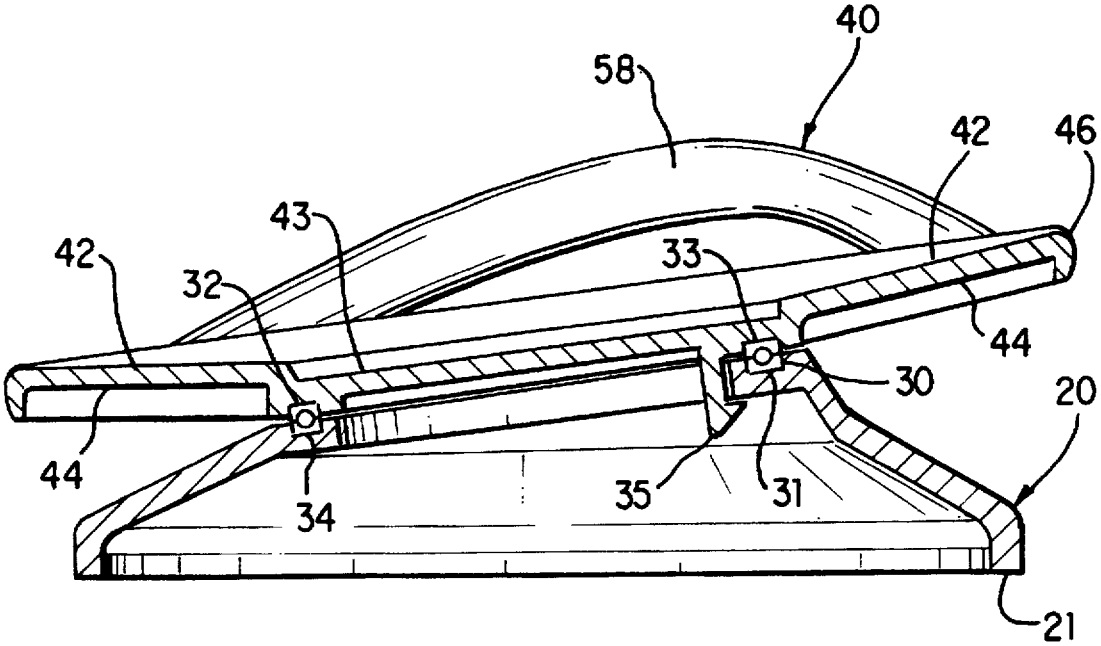
FIG. 3 is a cross-sectional view of the rotating platform apparatus, showing platform base, the inclined annular bearing ring, and the inclined platform.

As shown in FIG. 1 through FIG. 3, handles 58 may be molded as an integral part of the inclined platform 30 at opposite sides in proximity to the circumferential edge 48. Handles 58 may be molded as one piece, or may include a separate handle portion 59 which is secured to the inclined platform 30, to suit manufacturing or design preference. The separate handle portion 59 preferably includes a resilient handle portion.

In operation, the user positions the horizontal bottom portion 21 of the base 20 of the rotating platform apparatus 10 upon a rug, floor, ground or other substantial, generally horizontal surface. The user then positions themselves upon the inclined platform in a sitting, kneeling, standing or supine position (not shown) upon the inclined platform 40. Where appropriate, the user grasps the handles 58, and by shifting body weight or using hand or foot power, begins rotation. Because the annular bearing ring 30 is rotatably supported upon the annular base bearing surface 31, there is little resistance to rotation of the inclined platform 40.

The center of gravity of the user's weight tends to rotate to the lowest position on the inclined platform 40 when the inclined platform 40 is not being actively rotated. The centrifugal force of rotation provides continuous rotation even with an unbalanced load, providing an exciting spinning ride.

Thus, while the novel rotating platform apparatus has been fully disclosed and described herein, numerous modifications will become readily apparent to one of ordinary skill in this art, and such adaptations and modifications are intended to be included within the scope of the following claims:

What is claimed is:

1. A rotating platform apparatus, comprising:

a) a base having an inclined annular base bearing surface molded therein;

b) an annular bearing sized to rotatably engage the inclined annular base bearing surface;

c) an inclined platform having an upper portion sized to support a user thereon, the underside of the inclined platform having an inclined annular platform bearing surface molded therein, the inclined annular platform bearing surface sized to rotatably engage the annular bearing;

d) a flexible lip extending from the inclined platform into a closely received aperture in the base to releasably secure the inclined platform to the base, while allowing the inclined platform to freely rotate about the base; and e) opposing handles molded to extend from the inclined platform, and ergonomically sized to receive the user's hands thereon, to aid the user in rotating the inclined platform in relation to the base.

2. The rotating platform apparatus of claim 1, wherein the handles further comprise a resilient handle portion.

3. The rotating platform apparatus of claim 1, wherein the inclined rotating platform is inclined at a fixed angle in relation to the base, said fixed angle being inclined from five degrees to thirty-five degrees above a horizontal bottom portion of the base.

4. The rotating platform apparatus of claim 1, wherein the top portion of the inclined platform has a recessed central portion.

5. The rotating platform apparatus of claim 1, wherein the annular bearing is sized to be from six inches to sixteen inches in diameter.

6. The rotating platform apparatus of claim 1, wherein the annular bearing ring is inclined at a fixed angle in relation to the base of from five degrees to thirty-five degrees.

7. The rotating platform apparatus of claim 1, wherein the annular bearing is rotatably secured to at least one of the annular base bearing surface and the annular platform bearing surface.

* * * * *